US008591268B2

(12) United States Patent
Reimchen

(10) Patent No.: US 8,591,268 B2
(45) Date of Patent: Nov. 26, 2013

(54) ELECTRICAL PLUG-IN CONNECTOR AND ELECTRICAL PLUG-IN CONNECTION

(75) Inventor: Valeri Reimchen, Steinheim/Sandebeck (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 93 days.

(21) Appl. No.: 13/263,798

(22) PCT Filed: Mar. 22, 2010

(86) PCT No.: PCT/EP2010/001786

§ 371 (c)(1),
(2), (4) Date: Oct. 31, 2011

(87) PCT Pub. No.: WO2010/115514

PCT Pub. Date: Oct. 14, 2010

(65) Prior Publication Data

US 2012/0034809 A1 Feb. 9, 2012

(30) Foreign Application Priority Data

Apr. 9, 2009 (DE) ..... 10 2009 016 706
May 15, 2009 (DE) ..... 10 2009 021 594

(51) Int. Cl.
*H01R 13/502* (2006.01)

(52) U.S. Cl.
USPC ..... 439/701; 439/689; 439/695; 439/752.5

(58) Field of Classification Search
USPC ..... 439/695, 686, 701, 752.5
See application file for complete search history.

(56) References Cited

U.S. PATENT DOCUMENTS

| | | | | |
|---|---|---|---|---|
| 3,873,172 | A * | 3/1975 | Paullus | 439/498 |
| 4,090,772 | A * | 5/1978 | Goodman | 439/686 |
| 4,786,261 | A * | 11/1988 | Ramos, Jr. | 439/686 |
| 5,009,614 | A * | 4/1991 | Fogg et al. | 439/497 |
| 6,666,709 | B2 | 12/2003 | Andresen et al. | |
| 7,255,608 | B2 * | 8/2007 | Lalumandier et al. | 439/686 |
| 7,316,584 | B2 | 1/2008 | Mackillop et al. | |
| 7,621,786 | B2 | 11/2009 | Yavari et al. | |
| 7,824,233 | B2 * | 11/2010 | Thelen | 439/695 |

(Continued)

FOREIGN PATENT DOCUMENTS

| | | | |
|---|---|---|---|
| EP | 1 843 435 | A2 | 10/2007 |
| GB | 528 824 | A | 11/1940 |
| WO | 2008/059203 | A2 | 5/2008 |

*Primary Examiner* — James Harvey
(74) *Attorney, Agent, or Firm* — Roberts Mlotkowski Safran & Cole, P.C.; David S. Safran

(57) ABSTRACT

An electrical connector for detachable connection of a multi-core cable to a mating connector with a grip body which surrounds the cable and the cable cores, a contact carrier which holds a plurality of contact elements and a pivotally arranged sleeve-shaped threaded part. The individual contact elements are connected electrically conductively to the individual cores and the sleeve-shaped threaded part can be screwed to a corresponding sleeve-shaped threaded part of the mating connector. The connector contact elements mounted in corresponding open grooves of the contact carrier which run parallel to its longitudinal axis, and a side of the contact carrier facing the mating connector, bordering the grooves, has through holes corresponding to the number of grooves, through which holes the ends of the contact elements that face away from the cores project in the longitudinal direction of the contact elements, being inserted obliquely and pivoted in to a parallel orientation.

21 Claims, 9 Drawing Sheets

(56) References Cited

U.S. PATENT DOCUMENTS

2005/0112953 A1* 5/2005 Ratchford ..... 439/695
2005/0227545 A1* 10/2005 Lahoreau et al. ..... 439/695
2008/0124983 A1* 5/2008 Sundermeier ..... 439/690
2012/0034809 A1* 2/2012 Reimchen ..... 439/362

* cited by examiner

ELECTRICAL PLUG-IN CONNECTOR AND ELECTRICAL PLUG-IN CONNECTION

BACKGROUND OF THE INVENTION

1. Field of the Invention

The invention relates to an electrical connector for detachable connection of a multi-core cable to a mating connector, with a grip body which surrounds the cable and the cores of the cable, with a contact carrier which holds or accommodates a plurality of contact elements and with a pivotally arranged sleeve-shaped threaded part, the individual contact elements being connected electrically conductively to the individual cores and the sleeve-shaped threaded-part can be screwed to a corresponding sleeve-shaped threaded part of the mating connector.

In addition, the invention relates to an electrical plug-and-socket connection to a connector and a mating connector, the connector having a union nut as the sleeve-shaped threaded part and the mating connector having an outer sleeve with an inner thread which corresponds to the external thread of the union nut of the connector and a mating contact carrier which holds or accommodates a plurality of mating contact elements. Finally, the invention also relates to a method for connecting the cores of a multi-core cable to an electrical connector.

2. Description of Related Art

Electrical plug-and-socket connections consist essentially of two parts, the electrical connector and the mating connector. Both the connector and also the mating connector each have a contact carrier with a plurality of contacts which are either contact pins or corresponding jacks. Depending on whether there are contact pins or jacks in the respective contact carrier, the pertinent connecting part is also called a plug or a socket. In practice, it is generally such that the connector whose contact carrier has contact pins, i.e., the plug, has a union nut with an external thread as sleeve-shaped threaded part and the connector, in whose contact carrier there are jacks, i.e., the socket, has an outer sleeve with an inner thread. If two cables are connected to one another with the plug-and-socket connection, the outer sleeve of the socket is made as a type of union nut.

These electrical plug-and-socket connections and connectors are used as industrial plugs in automation engineering, both in switching cabinets and also in field devices in various versions. Especially models M8 and M12 with 4, 5, 6 or even 8 contacts are widely used. The connectors are used to connect cable sets with a corresponding number of cores, the individual cores each being comprised of a conductor and a core insulation which surrounds the conductor and being surrounded jointly by cable insulation. Instead of a solid conductor, the cores can also have several litz wires, subsequently—without limitation thereto—only conductors being addressed; this is thus intended to also comprise litz wires.

Electrical connectors can either be freely prepared or already completely wired, then the contact carrier and the cable generally are covered by the grip body. The grip body itself can also be produced by coating of the contact carrier.

In a connector which cannot be freely prepared by the consumer, the electrical and mechanical connection of the individual wires and conductors of a cable to the individual contact elements takes place especially by a solder connection or by a crimp connection. In crimp connection technology, the stripped end of a core is axially inserted into a corresponding connecting sleeve (crimp sleeve) or a sleeve-shaped end section of the contact element and then connected electrically and mechanically to the crimp sleeve or contact element by mechanically pressing the crimp sleeve or the sleeve-shaped end section together. By crimping, which has been standardized in DIN EN 60352-2, a solder-free electrical connection takes place and the crimp connection can be produced both by manual crimping tools and also by means of semiautomatic or fully automatic crimping machines. The stripping of the cores and the crimping of the contact elements can be done mechanically in one pass so that crimping technology has largely displaced soldering.

Electrical plug-and-socket connections are interfaces which transmit electrical signals or power, the plug-and-socket connections and the connectors, depending on the application, have to meet certain requirements. In connectors which are used in signal and data technology, especially in those connectors which are used within networks and field busses, certain high frequency boundary conditions must be considered according to the data transmission rate of the respective network or field bus in order to ensure faultless transmission of signals and data.

If the connectors or plug-and-socket connections are used for signal and data technology not only in office buildings, but also in a rough industrial environment, the connectors and plug-and-socket connections must be made accordingly more durable and must have a degree of protection as high as possible, preferably conforming with the IP67 protection rating. For this reason, commercial RJ45 plugs, as are known from office communications, can only be used to a limited degree in the industrial domain. Therefore, protective housings, so-called grommet housings, have been developed which can accommodate a RJ45 plug which is already connected to a cable and can thus protect the plug against external effects and damage. A corresponding protective housing is disclosed for example, in German Patent DE 100 31 341 C2 and corresponding U.S. Pat. No. 6,666,709 B2.

In order to be able to use the connectors of the model M12 type, which are common for industrial applications and which have sufficient mechanical durability and protection rating, even in the area of signal and data technology, especially in networks and field busses—and here, especially also for Ethernet applications—their inner structure must be modified such that the requirements can be satisfied with respect to data transmission. In particular, for higher transmission rates, connectors with a larger number of contacts, especially with eight contacts, are necessary. If the number of contacts is increased, this leads—for otherwise uniform diameter of the connector—to more expensive mounting of the connector and to more expensive connection of the individual cores to the individual contact elements as a result of the smaller dimensions.

SUMMARY OF THE INVENTION

Therefore, the object of this invention is to develop the initially described electrical connector such that the mounting of the connector, especially the mounting of the contact elements in the contact carrier, is more easily possible. Moreover, the object of the invention is to devise an electrical plug-and-socket connection which is especially well suited to signal and data transmission in a rough industrial environment, with a structure as compact as possible.

The aforementioned object is achieved in the initially described type of electrical connector in that a number of grooves is made in the contact carrier which are open to the outside and which run parallel to the longitudinal axis of the contact carrier, which number corresponds to the number of contact elements, and that a number of through holes corresponding to the number of grooves is made in the face side of the contact carrier facing the mating connector bordering the grooves, and through which the ends of the contact elements facing away from the cores project in the lengthwise direction of the contact elements in the mounted state.

The configuration of the contact carrier in accordance with the invention greatly simplifies the insertion of the contact elements into the contact carrier. By making the grooves open to the outside, instead of the through holes which are made otherwise in contact carriers and which extend over the entire length of the contact carrier, a contact element with its ends facing away from the connected cores can be easily inserted through the through hole in the face side of the contact carrier, and the contact element can have an angle relative to the longitudinal axis of the contact carrier that is greater than zero when inserted through the through hole. The free end of the contact element can thus be pushed through the through hole "obliquely from the side" and only afterwards can be pivoted into the corresponding grooves.

This procedure greatly simplifies the insertion of the contact elements which are already connected to the cores into the contact carrier. On the one hand, the free ends of the contact elements must be pushed only through the through holes which are made in the face side of the contact carrier and whose length is much smaller than the total length of the contact carrier. On the other hand, the possibility of inserting the contact element "obliquely from the side" facilitates the mounting of even a plurality of contact elements in a compact connector.

According to one advantageous configuration of the invention, the through holes in the face side of the contact carrier are made funnel-shaped, the inside diameter of the through holes increasing from the side facing the grooves to the side facing the mating connector. The funnel-shaped execution of the through holes facilitates the slanting of the contact elements when inserted into the through holes. The insertion and pivoting of the contact elements are further facilitated if the funnel shape of the through holes is aligned concentrically relative to the preferred insertion direction of the contact elements. In addition, the through holes can be made such that they have a slightly larger diameter on their narrowest side than the ends of the contact elements which are to be pushed through.

The individual contact elements in the electrical connector in accordance with the invention are routed in a through hole only in a relatively small region of their total length, while the free end projects out of the through hole and the end facing the cores, in the mounted state, is located in the groove which is outwardly open. In this way, the axial alignment of the contact elements is less well secured than in conventional contact carriers in which the length of the through holes corresponds to the length of the contact carrier. In order to better ensure the axial alignment of the contact elements in the contact carrier, it is therefore preferably provided that the through holes are each surrounded by a shroud on the side of the contact carrier facing the mating connector. So that the shroud does not inhibit the insertion of the free end of a contact element "obliquely from the side," the side of the shroud facing the middle axis of the connector has an interruption.

In order to better ensure the axial alignment of the contact elements in the contact carrier, and in order to prevent unwanted pivoting of the contact elements out of the grooves, a constriction is preferably made in the individual grooves which the contact elements can engage when pivoting into the grooves. If the contact elements have a section with an enlarged diameter correspondingly to the grooves, for example, a hollow end facing the cores, locking between the constriction formed in the grooves and the section with the enlarged diameter can be easily accomplished.

The above described configuration of the contact carrier in accordance with the invention can be used, fundamentally, in all round connectors. The configuration of the contact carrier in accordance with the invention is, however, especially advantageous in those connectors which have a larger number of contact elements, especially for connectors which are used to connect cables with four core pairs and which thus have eight contact elements. In this type of connector, according to another advantageous configuration of the invention, it is provided that the contact carrier has four contact carrier parts, each of which has a quadrant-shaped base surface. If the connector is intended to connect four core pairs, two grooves are formed in each contact carrier part and in the side of each contact carrier part facing the mating connector, correspondingly, two through holes are made. The two cores of a core pair, which are preferably twisted with another, are thus connected to two contact elements which are located in a contact carrier part after mounting.

If the electrical connector is used to connect a cable of the signal and data hardware, especially for connecting a cable in which the twisted core pairs are surrounded with a metallic shield (FTP—foiled twisted pair or PiMF—pair in metal foil), according to another advantageous configuration, the electrical connector additionally has a cylindrical sleeve with a cross-shaped shielding element which is located within the sleeve and which extends in the longitudinal direction of the sleeve. The four contact carrier parts are then located within the cylindrical sleeve such that the individual contact carrier parts are separated from one another by the arms of the cross-shaped shielding element. In this way, feed-through from one core pair to another core pair can be prevented for the most part, for which the sleeve and the shielding element preferably are made of metal. For simplified mounting of the electrical connector, the sleeve and the shielding element are preferably made in one piece.

According to a preferred configuration, the cross-shaped shielding element projects out of the sleeve on the side facing the cable so that the metallic shields of the individual twisted core pairs (PiMF) can be attached on the projecting end of the shielding element, as a result of which the shielding between the individual core pairs is further improved, and thus, the probability of feed-through from one core pair to the other core pair is further reduced.

To further facilitate the positioning of the individual contact carrier parts within the sleeve, on the inner periphery of the sleeve preferably one stop for the contact carrier parts is formed. After inserting the contact elements into the individual contact carrier parts, they can thus be easily inserted into the chambers formed by the sleeve and the cross-shaped shielding element.

In the initially described electrical plug-and-socket connection comprised of a connector and a mating connector, the connector having a grip body which encompasses the cable, a contact carrier which holds or accommodates a plurality of contact elements, and a pivotally arranged union nut with an external thread and the mating connector having an outer sleeve with an inside thread which corresponds to the external thread of the union nut, and a mating contact carrier which holds or accommodates a plurality of mating contact elements, the suitability of the plug-and-socket connection for signal and data transmission, especially for Ethernet applications, is easily improved in that the mating contact elements of the mating connector have a region which extends in the axial direction in which the outside diameter is reduced for impedance matching.

In order to be able to ensure error-free data transmission in plug-and-socket connections, especially in those which are used in bus connections or networks with high data transmission rates, certain high-frequency boundary conditions must be considered. In addition to a feed-through between the individual core pairs that is as small as possible, the reduction of the return loss is of special importance. The return loss is determined essentially by the homogeneity of the surge impedance. If an impedance jump occurs in the propagation direction of the electromagnetic wave, this leads to reflections which can be superimposed with the useful signals to be transmitted so that partial extinguishing of the useful signal to be transmitted can occur due to interference.

Since in an electrical plug-and-socket connection which is to be used in the industrial domain, in addition to the high frequency boundary conditions, other requirements such as a protection rating that is as high as possible, sufficient compactness with simultaneously high mechanical stability and the capacity to be produced as easily as possible must also be considered, it can happen that the contact elements of the connector, in practice, have a differential series impedance different from the mating contact elements of the mating connector. In accordance with the invention, it has now been recognized that a difference between the differential series impedance of the contact elements of the connector and of the differential series impedance of the mating contact elements of the mating connector can be, for the most part, reduced by the mating contact elements having a region which extends in the axial direction in which the outside diameter is reduced compared to the outside diameter in the other regions of the mating contact element.

In this way, impedance matching of the mating contact elements to the contact elements is possible without other parameters of the plug-and-socket connection, for example, the electrical conductivity of the contact elements and of the mating contact elements or the distance of the contact elements and the mating contact elements to one another, having to be changed. Since the differential series impedance depends on the ratio of the diameter of one contact element or mating contact element to the center distance to adjacent contact elements or mating contact elements, the differential series impedance of the mating contact elements can be matched by changing the diameter of the mating contact elements such that the differential series impedance of the mating contact elements corresponds roughly to a defined setpoint value, for example, 100 ohms.

According to one advantageous configuration of the electrical plug-and-socket connection, the end of the contact elements which faces the mating contact elements is pin-shaped and the end of the mating contact elements which faces the contact elements is made hollow so that the pin-shaped ends of the contact elements can be inserted into the hollow ends of the mating contact elements. If the ends of the mating connecting elements facing away from the contact elements are made pin-shaped, the mating contact elements on the device side can be easily connected to a circuit board, for example, by a wave soldering method.

In order to stop feed-through between individual cores or individual core pairs in the electrical plug-and-socket connection in the mating plug as well, the mating contact carrier of the mating connector, according to one preferred configuration, is formed of four mating contact carrier parts, each of which has a quadrant-shaped base surface, in each mating contact carrier part there being at least one bore which extends in the longitudinal direction for accommodating a mating contact element. In this configuration of the mating contact carrier, the four mating contact carrier parts are preferably shielded relative to one another by a cross-shaped shielding element which extends in the longitudinal direction of the outer sleeve or of the mating contact carrier and which is located within the outer sleeve. The four contact carrier parts are connected to one another in regions preferably on their outer periphery so that the cross-shaped shielding element is located in corresponding grooves which are formed between the individual mating contact carrier parts in the mounted state of the mating connector.

According to another advantageous configuration of the electrical plug-and-socket connection in accordance with the invention, in which both the mating connector and also the connector have a cross-shaped shielding element, the individual arms of the cross-shaped shielding element of the connector on the side facing the mating connector each have an extension which extends in the longitudinal direction of the connector and the individual arms of the cross-shaped shielding element of the mating connector on the side facing the connector each have a corresponding mating extension which extends in the longitudinal direction of the mating connector. The extensions and the mating extensions are made and arranged such that they overlap in the axial direction when the connector and the mating connector are connected to one another. Axial "overlapping" of the cross-shaped shielding element of the connector with the cross-shaped shielding element of the mating connector effectively prevents feed-through from one core pair to another core pair over the entire length of the electrical plug-and-socket connection.

In addition to the initially described electrical connector and the above described electrical plug-and-socket connection, this invention also relates to a method for connecting the cores of a multi-core cable to an electrical connector, the electrical connector—as described above—having a grip body, a contact carrier for accommodating a plurality of contact elements, and a pivotally arranged sleeve-shaped threaded part. The contact carrier of the connector has a number of grooves which are open to the outside and which run parallel to the longitudinal axis of the contact carrier which corresponds to the number of contact elements, and in the face side of the contact carrier facing away from the cores, bordering the grooves, a corresponding number of through holes. In the method the connection of the individual stripped cores is characterized by the following steps:

- connecting the individual stripped ends of the cores to the facing ends of the individual contact elements,
- pushing the ends of the contact elements facing away from the cores through the through holes in the face side of the contact carrier, the contact elements having an angle relative to the longitudinal axis of the contact carrier that is greater than zero when pushed through, and
- pivoting of the contact elements into the grooves in the contact carrier so that the contact elements and with them the cores run parallel to the longitudinal axis of the contact carrier.

Advantageously, the method in accordance with the invention, for an electrical connector in which the end of the contact elements which faces the cores is made hollow, can be mechanically carried out especially easily in that the individual stripped ends of the cores are inserted into the hollow ends of the contact elements and are connected to the individual contact elements in an electrically conductive manner by mechanical crimping of the ends of the individual cores. To do this, a contact element with cores inserted into the hollow end can be inserted into the receiver of a corresponding press jaw and then, by pressing down a mating jaw, the contact element in the region of the inserted cores can be pressed together, as a result of which the stripped end of the cores is electrically connected mechanically securely to the contact element.

If the individual contact elements with the cores which are electrically conductively connected thereto are inserted into the contact carrier or into individual contact carrier parts, the contact carrier and the contact carrier parts are preferably pushed into a cylindrical sleeve with a cross-shaped shielding element which extends in the longitudinal direction of the sleeve and which is located within the sleeve. Accordingly, the sleeve-shaped threaded part is slipped onto the sleeve and then the cores connected to the contact elements and the contact carrier part or the contact carrier parts are covered for producing a grip body.

In particular, there is a host of possibilities for configuring and developing the electrical connector in accordance with the invention and the electrical plug-and-socket connection in accordance with the invention and the method in accordance with the invention as will be apparent from the following description of a preferred exemplary embodiment in conjunction with the accompanying drawings.

DETAILED DESCRIPTION OF THE INVENTION

Figure 1:
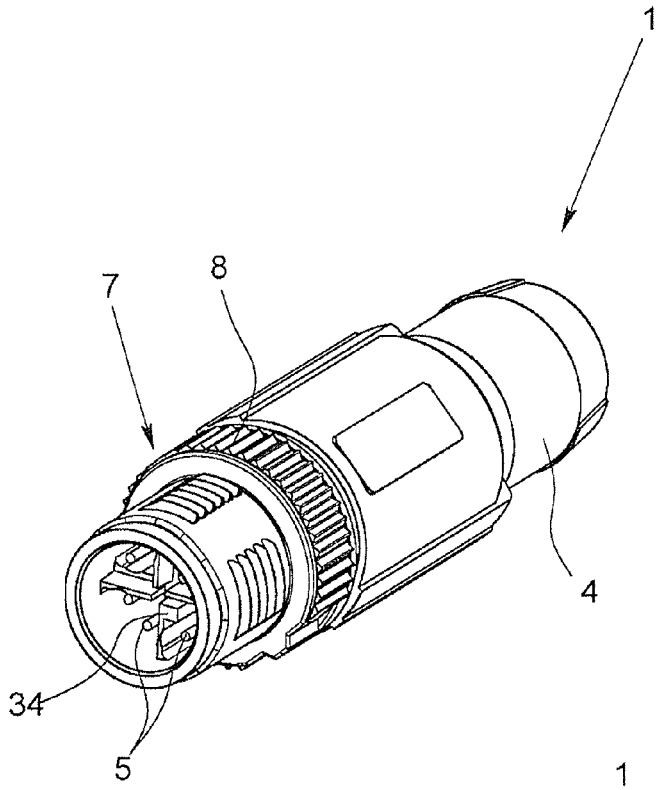
FIG. 1 is a perspective of an electrical connector in accordance with the invention.
Figure 2:
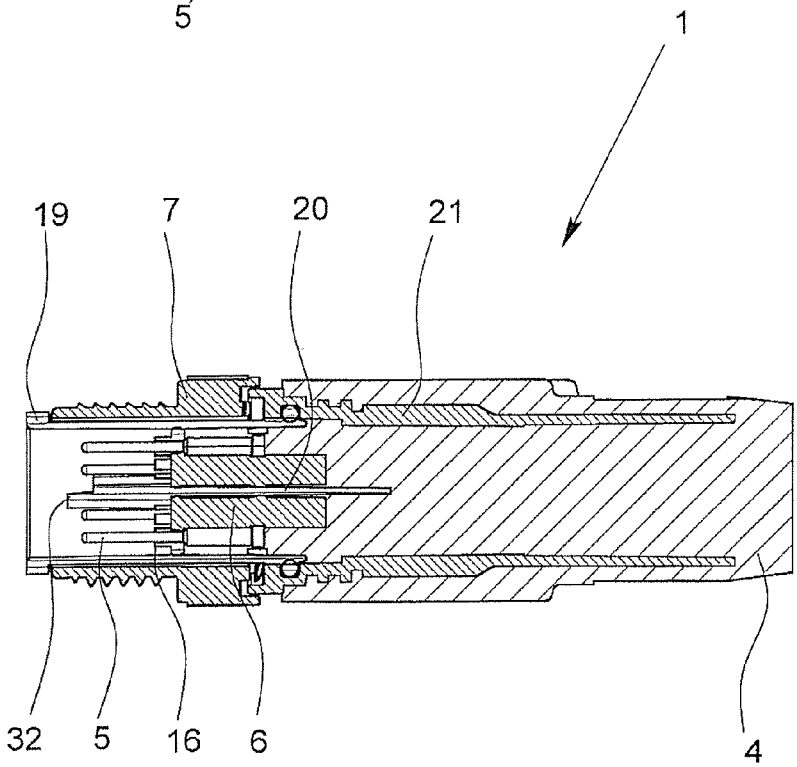
FIG. 2 is a longitudinal sectional view of the electrical connector according to FIG. 1.
Figure 3:
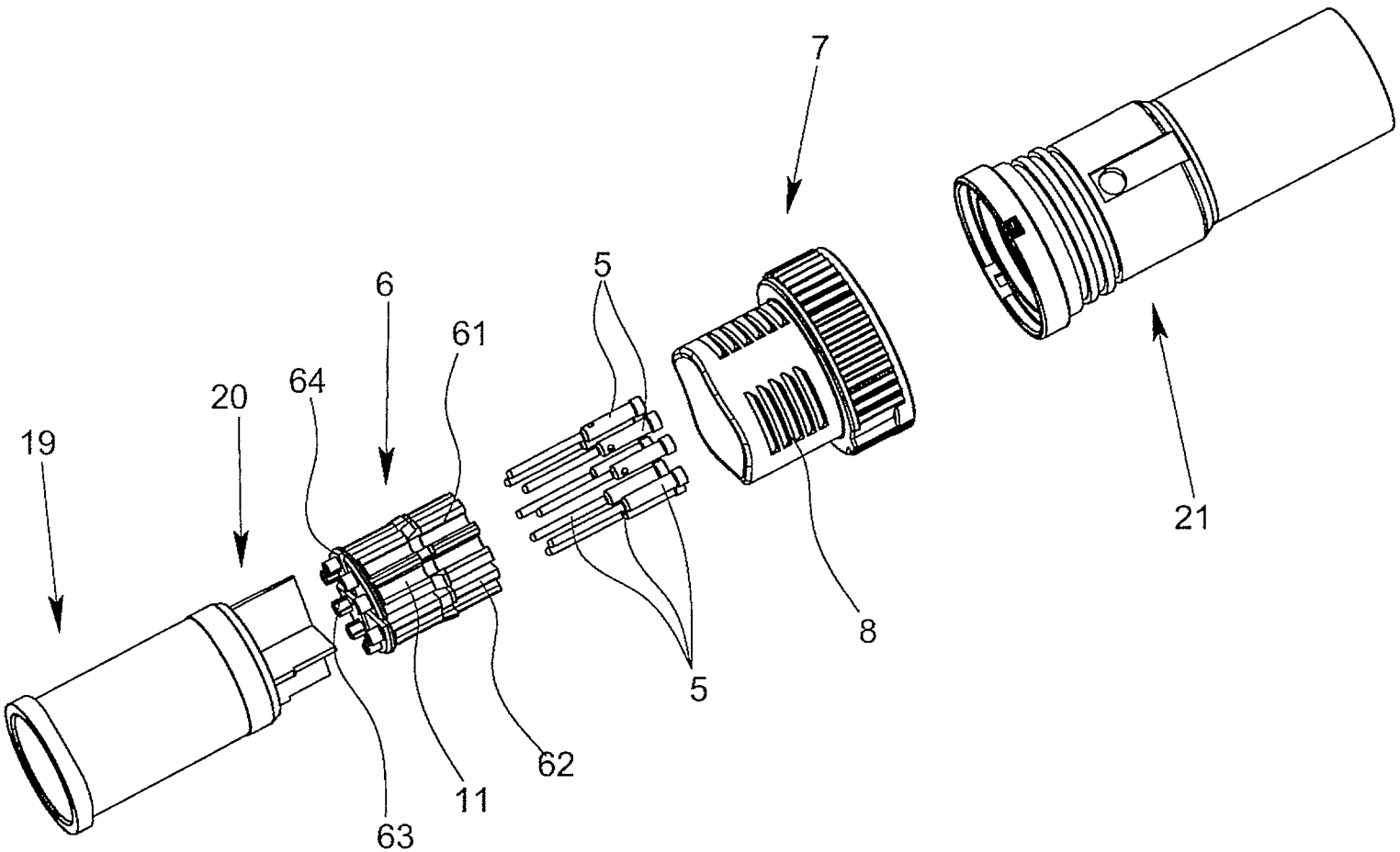
FIG. 3 is an exploded view of the important components of the electrical connector according to FIG. 1.
Figure 4:
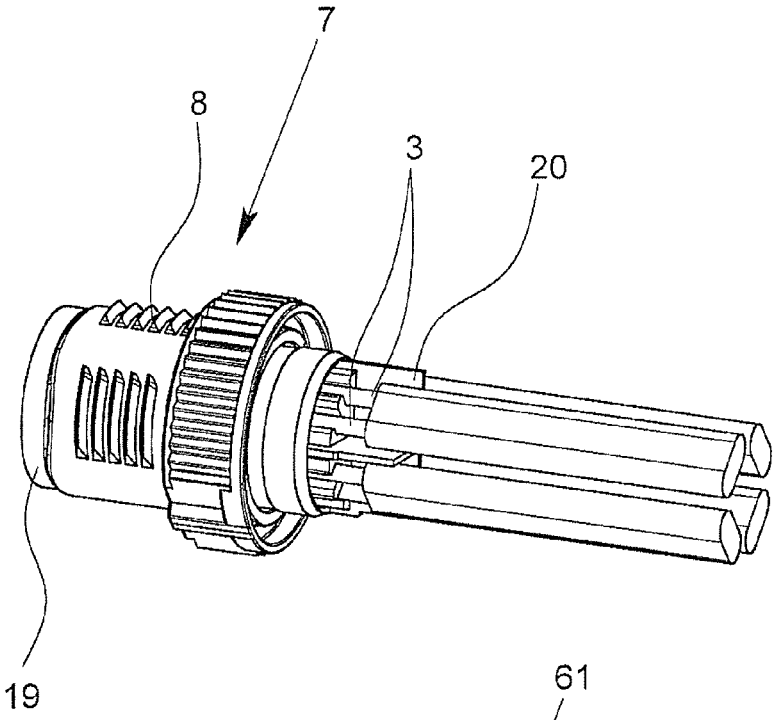
FIG. 4 is an enlarged perspective view of part of the connector, with cores connected.
Figure 8:
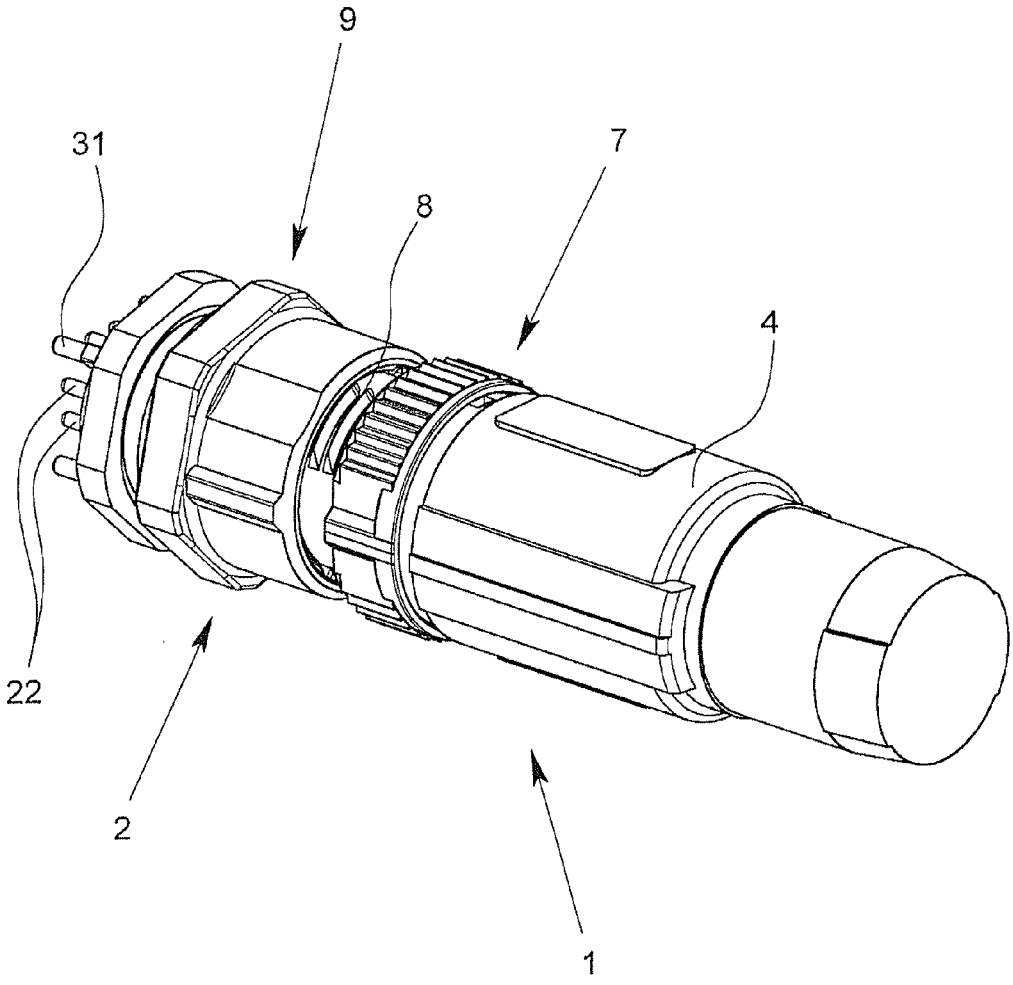
FIG. 8 is a perspective of an electrical plug-and-socket connection comprised of a connector and a mating connector.
Figure 9:
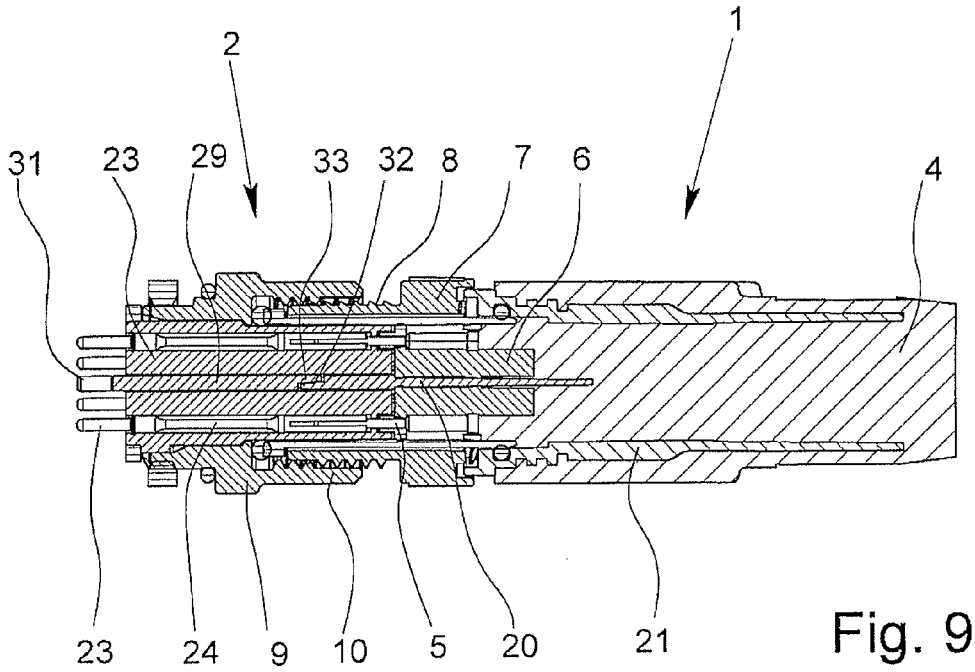
FIG. 9 is a longitudinal sectional view of the electrical plug-and-socket connection of FIG. 8.
Figure 10:
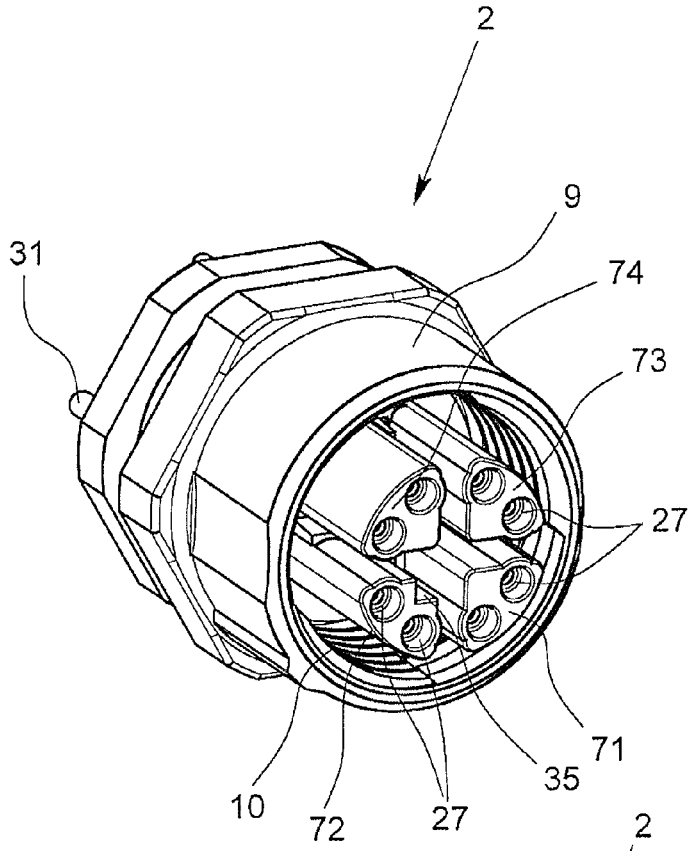
FIG. 10 is a perspective of the mating connector of the electrical plug-and-socket connection.
Figure 11:
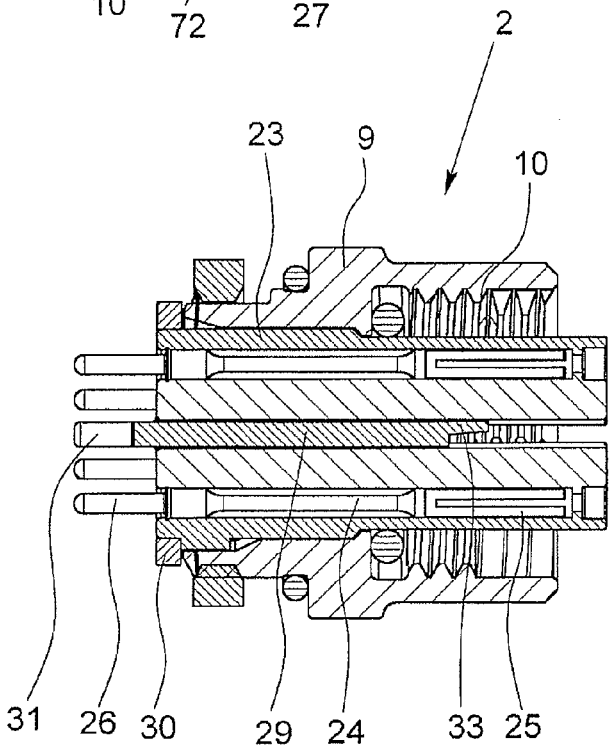
FIG. 11 is a longitudinal sectional view of the mating connector of FIG. 10.
Figure 12:
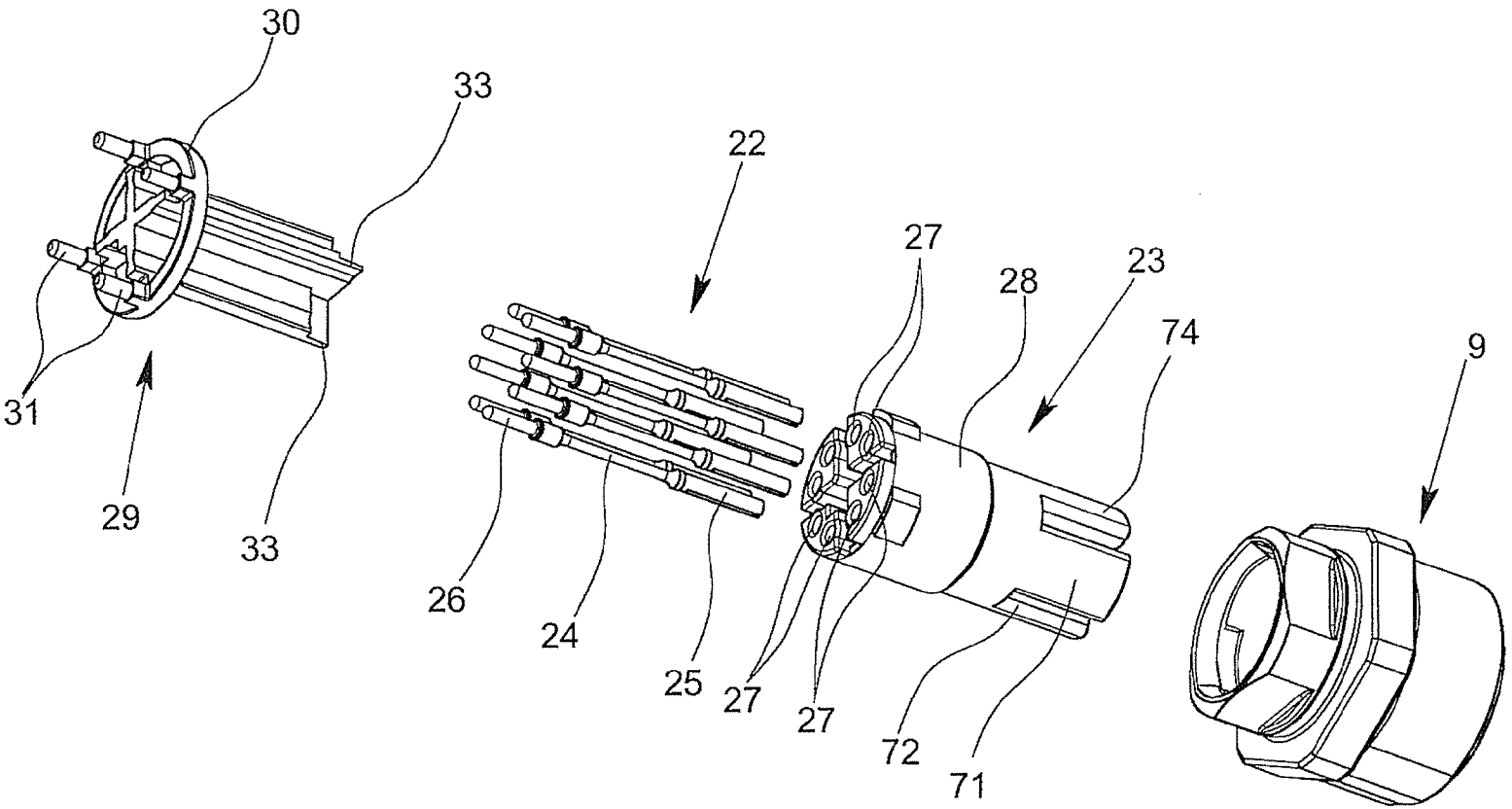
FIG. 12 is an exploded view of important components of the mating connector.

FIGS. 1 to 3 show an electrical connector 1 as part of an electrical plug-and-socket connection which is shown as a whole in FIGS. 8 & 9. The electrical connector 1 is used for detachable connection of a cable to a mating connector 2, which is shown in FIGS. 10 to 12. The electrical connector 1 has a grip body 4 which surrounds the cable and the cores 3 (shown in FIG. 4), a contact carrier 6 which holds and accommodates a total of eight contact elements 5, and a pivotally arranged union nut 7 with an external thread 8. The electrical connector 1 can be connected to the mating connector by threading the external thread 8 of the union nut 7 into the outer sleeve 9 of the mating connector 2 which has a corresponding inner thread 10.

As is apparent from FIGS. 1 and 10, both the external thread 8 of the union nut 7 and also the inner thread 10 of the outer sleeve 9 are interrupted in regions, i.e., both the external thread 8 and also the inner thread 10 have several unthreaded regions which are provided in a plug-in or screw-on direction. In this way, it is possible to insert the union nut 7 of the connector 1 first into the outer sleeve 9 of the mating connector 2, for reliable attachment of the connector 1 and mating connector 2, the union nut 7 having to be turned only by less than one half revolution to secure the connection. In this way, the time necessary for attaching or releasing the plug-and-socket connection can be distinctly reduced. A similar electrical plug-and-socket connection in which the external thread and the inner thread each have unthreaded regions is sold by the assignee of the present application under the product name "SPEEDCON" (compare brochure "Industrial Plug PLUSCON 2005", pages 58 and 59 of Phoenix Contact, Blomberg).

In the preferred configuration of the electrical connector 1 shown in the figures, the contact carrier 6 has four separate contact carrier parts 61, 62, 63, 64 each of which has a quadrant-shaped base area. As is especially apparent from FIGS. 5 and 7, in the individual contact carrier parts 61, 62, 63, 64, two grooves are provided which are outwardly open and which run parallel to the longitudinal axis of the connector 1 or of the contact carrier 6. The grooves 11 are used to accommodate a part of the contact elements 5. Moreover, in the side 12 of the individual contact carrier parts 61, 62, 63, 64 that faces the mating connector 2, two through holes 13 are formed which are arranged in the face side 12 such that they directly border the grooves 11 so that the ends 14 of the contact elements 5 facing away from the cores 3 extend through the through holes 13 in the mounted state. Since the electrical connector 1 shown in the figures has a total of eight contact elements 5, in the contact carrier 6 a total of eight grooves 11 and eight through holes 13 are also formed.

Figure 6:
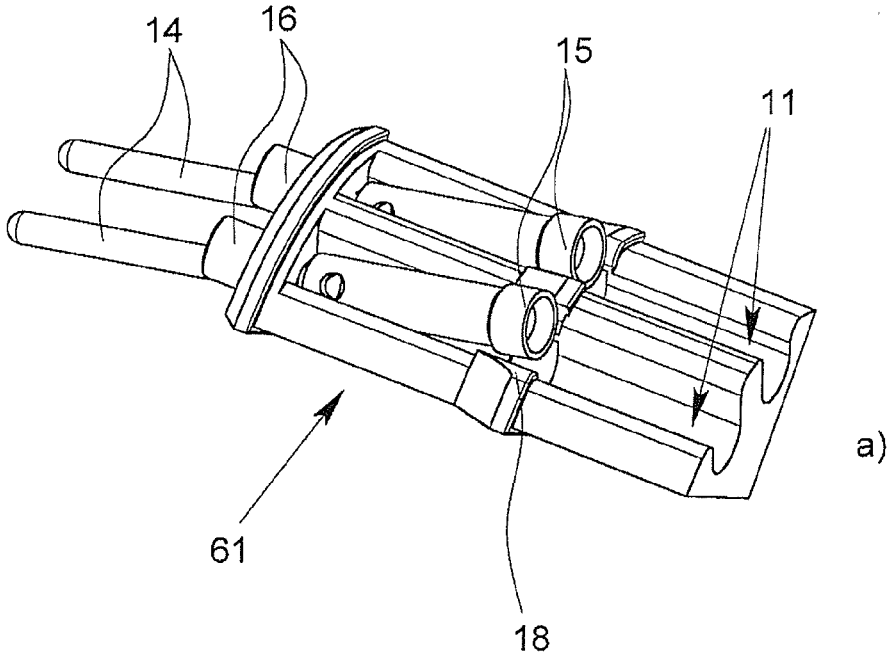
FIG. 6 shows two views of a contact carrier part with two contact elements, part a) of the figure showing the contact elements pivoted up at an angle relative to the contact carrier part, and part b) of the figure showing the contact elements pressed down in grooves of the carrier part.
Figure 6:
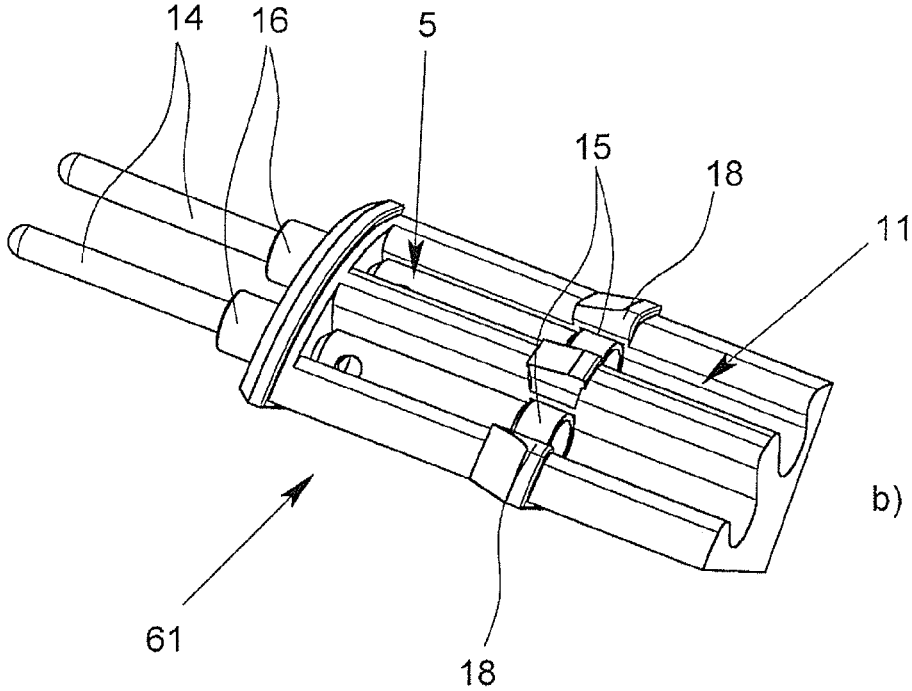
Figure 7:
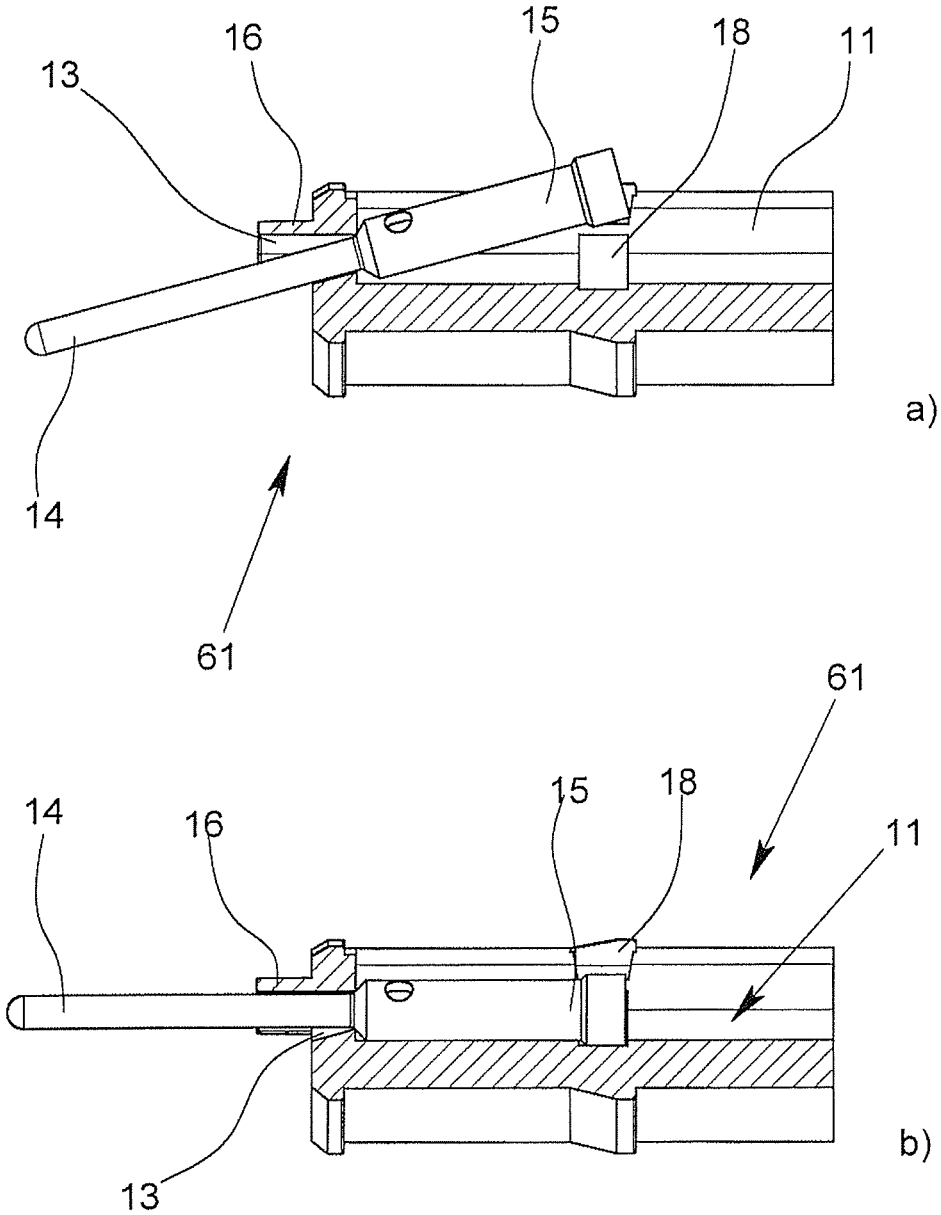
FIG. 7, in parts a) & b) shows, sectional views of the contact carrier part corresponding to parts a) and b) of FIG. 6.

As is especially apparent from the two views in FIGS. 6 and 7, a contact element 5 can be especially easily mounted in the contact carrier 6 or a contact carrier part 61 by the above described execution of the grooves 11 which are outwardly open and the through holes 13 in that first the free, pin-shaped end 14 is inserted at an angle greater than zero relative to the longitudinal axis of the contact carrier part 61, i.e., obliquely from the side through the through hole 13 (FIGS. 6*a* and 7*a*). Only afterwards is the contact element 5 aligned in the longitudinal direction of the contact carrier part 61 by the hollow end 15 of the contact element 5 facing the cores 3 being pivoted or pressed into the groove 11.

Figure 5:
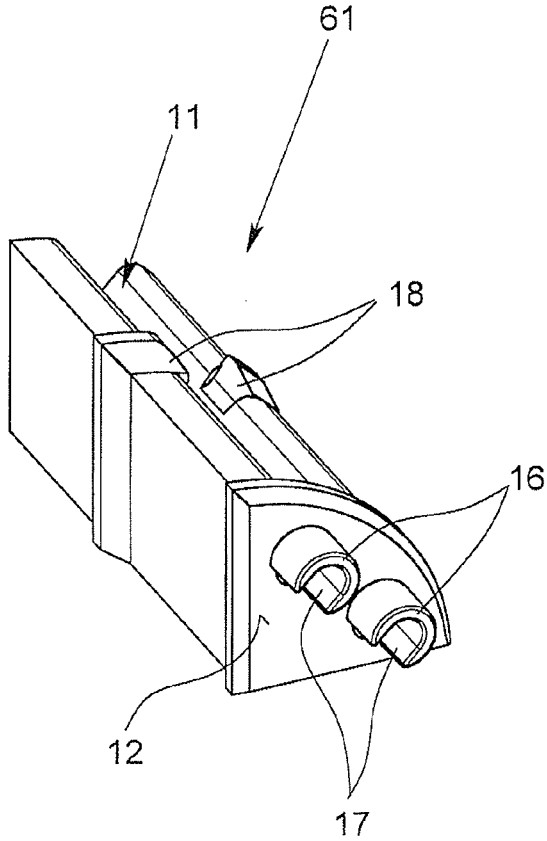
FIG. 5 is an enlarged perspective view of a contact carrier part of the electrical connector.

Moreover, FIGS. 5 to 7 show that the through holes 13, on the side 12 of the contact carrier 6 or of the individual contact carrier parts 61, 62, 63, 64 facing the mating contact 2, are surrounded by a shroud 16, the shroud 16 having an interruption 17 on the side facing the center axis of the plug 1. Moreover, a constriction 18 is formed in the grooves 11 in the region of the hollow ends of the contact elements 5 facing the cores 3. This ensures that the contact elements 5 cannot unintentionally fall or pivot out of the grooves 11 after pivoting or pressing into the grooves 11.

The exploded view of the connector 1 of FIG. 3 shows that the connector 1, in addition, has another cylindrical sleeve 19 with a cross-shaped shielding element 20 formed within the sleeve 19 and a shielding sleeve 21. The cylindrical sleeve 19 with the cross-shaped shielding element 20 which is connected in one piece to the sleeve 19 and which is located in the sleeve is used to accommodate the individual contact carrier parts 61, 62, 63, 64 with the contact elements 5 located therein. The cross-shaped shielding element 20 thus separates the individual contact carrier parts 61, 62, 63, 64, and thus, the contact elements 5 located in the contact carrier parts 61, 62, 63, 64, from one another so that feed-through between a shielded core pair assigned to a contact carrier part 61 and another shielded core pair assigned to a second contact carrier part 62 is for the most part prevented.

The arrangement of the other shielding sleeve 21 on the side of the electrical connector 1 facing away from the mating connector 2, which side is located in the grip body 4 which has been produced by molding or casting, additionally shields the individual cores 3 or the individual core pairs. FIG. 2 shows that the cross-shaped shielding element 20 and the shielding sleeve 21 are arranged and made such that they overlap in the longitudinal direction of the connector 1. In the sectional view, moreover, a gasket and a snap ring can be recognized; they are omitted in the exploded drawing as shown in FIG. 3 since they are not critical to the invention.

The illustration of the mating connector 2 in FIGS. 10 to 12 shows that the mating connector 2, in addition to the outer sleeve 9 with the inner thread 10 which corresponds to the external thread 8 of the union nut 7, especially includes a mating contact carrier 23 which holds and accommodates a total of eight mating contact elements 22.

Figure 13:
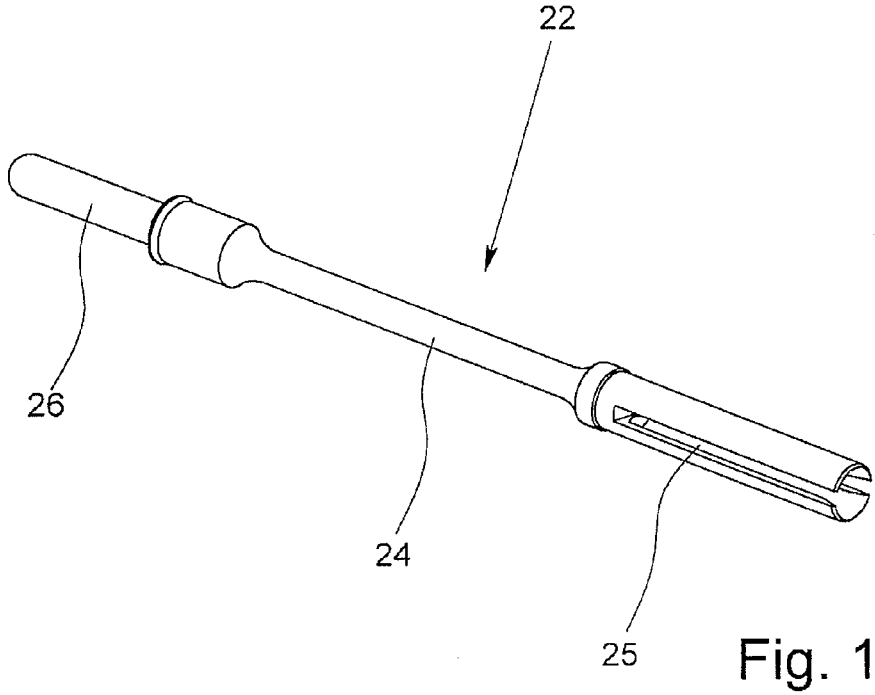
FIG. 13 is a perspective of a mating connecting element of the mating connector.

FIGS. 11 to 13 show that the mating contact elements 22 have a middle region 24 in which the outside diameter is reduced compared to the outside diameter of the other regions of the mating contact elements 22. The reduction of the outside diameter of the contact elements 22 in the middle region 24 is used to match the differential series impedance of the mating contact elements 22, as a result of which an impedance jump in the longitudinal direction of the electrical plug-and-socket connection will be avoided. Since the differential series impedance of the individual mating contact elements 22 depends, among others things, on their outside diameter and on the center distance of the mating contact elements 22 relative to one another, by reducing the outside diameter in the middle region 24 of the mating contact elements 22, impedance matching can be achieved without the arrangement of the individual mating contact elements 22 having to be changed.

In particular FIGS. 12 and 13 show that the end 25 of the mating contact elements 22 facing the contact elements 5 of the electrical connector 1 is made hollow so that the pin-shaped ends 14 of the contact elements 5 can be inserted into the hollow ends 25 of the mating contact elements 22. The ends 26 of the mating contact elements 22 facing away from the contact elements 5 are conversely made pin-shaped so that the mating connector 2 can be connected for example, to a circuit board.

As is especially apparent from FIGS. 10 and 12, the mating contact carrier 23 of the mating connector 2 have four mating contact carrier parts 71, 72, 73, 74 each of which have a quadrant-shaped base area. Corresponding to the contact carrier parts 61, 62, 63, 64, the mating contact carrier parts 71, 72, 73, 74 each have two bores 27, which extend in the longitudinal direction of the mating contact carrier parts 71, 72, 73, 74, for accommodating the mating contact elements 22. However, in contrast to the contact carrier parts 61, 62, 63, 64, the four mating contact carrier parts 71, 72, 73, 74, are connected to one another via a ring 28 which is connected in one piece to them.

In the same manner as the electrical connector 1, the mating connector 2 also has a cross-shaped shielding element 29 by which the individual mating contact carrier parts 71, 72, 73, 74, and thus, the mating contact elements 22 located therein, are shielded against one another. Instead of a sleeve 19, the cross-shaped shielding element 29 of the mating connector 2 has an annular section 30 on the side facing away from the connector 1 which adjoins the face side of the outer sleeve 9 in the mounted state. On the ring-shaped section 30, there are four pins 31, by means of which the mating connector 2 can be mounted on a circuit board.

It is apparent from the sectional views of FIGS. 2, 9, and 11 that the individual arms of the cross-shaped shielding elements 20 of the connector 1 have an extension 32 on the side facing the mating connector 2 which extends in the longitudinal direction of the connector 1, and the individual arms of the cross-shaped shielding element 29 of the mating connector 2 have a corresponding mating extension 33 on the side facing the connector 1 that extends in the longitudinal direction of the mating connector 2. The extensions 32 and the mating extensions 33 are made and arranged such that they overlap in the axial direction, i.e., in the longitudinal direction of the plug-and-socket connection, when the connector 1 and the mating connector 2 are connected to one another (FIG. 9).

In order to ensure the correct alignment of the individual contact elements 5 relative to the individual mating contact elements 22, between the connector 1 and the mating connector 2 the configuration is made so that the connector 1 and the mating connector 2 can only be screwed to one another in a certain orientation to one another. The configuration is formed by an orientation projection 34 (FIG. 1) which is made on the crossing region of the cross-shaped shielding element 20 and of a corresponding polarization recess 35 (FIG. 10) which is made on the mating contact carrier part 72.

The figures show an especially preferred configuration of an electrical plug-and-socket connection, formed of an electrical connector 1 and a mating connector 2, the electrical connector 1 being suitable and designed to detachably connect four shielded core pairs via the eight contact elements 5 which are located in four contact carrier parts 61, 62, 63, 64 to the eight mating contact elements 22 of the mating connector 2 which are located in the mating contact carrier 23. Due to the durable and compact execution of the connector 1 and of the mating connector 2 and by the arrangement and execution of the cross-shaped shielding elements 20, 29, which preferably are made of metal, a plug-and-socket connection is provided which is especially well suited for Ethernet applications in a rough industrial environment. With the described plug-and-socket connection especially the requirements according to Cat6a (an enhanced performance standard from the Telecommunications Industry Association for twisted pair cable systems defined in ANSI/TIA/EIA-568-B.2-10.) are satisfied so that the plug-and-socket connection is also suited for 10 gigabit Ethernet and other network protocols.

The invention claimed is:

1. Electrical connector for detachable connection of a multicore cable to a mating connector, comprising:

a grip body adapted for surrounding a cable and cores of the cable, a plurality of contact elements, each contact element being electrically conductively connectable to a respective core of the cable, a contact carrier which holds or accommodates said plurality of contact elements, and a first sleeve-shaped threaded part, the first sleeve-shaped threaded-part having a thread for screwed connection to a corresponding second sleeve-shaped threaded part of the mating connector, wherein a plurality of grooves, which correspond to the number of contact elements, are provided in the contact carrier, the grooves being outwardly open and running parallel to a longitudinal axis of the contact carrier , and wherein a face side of the contact carrier directed toward an open end of the first sleeve-shaped threaded part has a number of through holes bordering the grooves which correspond in number to the number of grooves, and wherein ends of the contact elements which, in a mounted state project, face away from the cores and extend through said through holes.

2. Electrical connector as claimed in claim 1, wherein the through holes are funnel-shaped, an inside diameter of the through holes increasing from a side facing the grooves to a side facing the open end of the first sleeve-shaped threaded part.

3. Electrical connector as claimed in claim 1, wherein each of the through holes is each surrounded by a shroud at a side facing the open end of the first sleeve-shaped threaded part, and wherein each of the shrouds has an interruption on a side facing a middle axis of the connector.

4. Electrical connector as claimed in claim 1, wherein a constriction is formed in each of the grooves for locking with a corresponding section of a respective one of the contact elements.

5. Electrical connector as claimed in claim 1, wherein the contact carrier comprises four contact carrier parts, each of which has a quadrant-shaped base surface, each contact carrier part having at least one of said grooves and at least one of said through holes.

6. Electrical connector as claimed in claim 5, wherein the four contact carrier parts are surrounded by a cylindrical sleeve and are separated from one another by a cross-shaped shielding element which is located within the sleeve and which extends in a longitudinal direction of the sleeve.

7. Electrical connector as claimed in claim 6, wherein the sleeve and the shielding element are formed of one piece of metal and wherein a stop for the contact carrier parts is provided on an inner periphery of the sleeve.

8. Electrical connector as claimed in claim 6, wherein the cross-shaped shielding element has a length sufficient to enable an end thereof to project out of the sleeve, in the mounted state, so that metallic shielding of the cores can be attached to the end of the shielding element that projects out of the sleeve.

9. Electrical connector as claimed in claim 1, wherein the end of the contact elements which, in a connected state, faces away from the cores is pin-shaped and the end of the contact elements facing the cores is hollow, with an outside diameter of the end facing the cores being greater than an inside diameter of said through holes.

10. Electrical plug-and-socket connection comprising a connector and a mating connector, wherein the mating connector comprises:

a mating contact carrier which holds or accommodates a plurality of mating contact elements, and wherein the connector comprises:

a grip body adapted for surrounding a cable and cores of the cable, a plurality of contact elements, each contact element being electrically conductively connectable to a respective core of the cable, a contact carrier which holds or accommodates said plurality of contact elements, and a union nut having an external thread for screwed connection to an inner thread of an outer sleeve of the mating connector, and wherein the mating contact elements of the mating connector have a region which extends in the axial direction and in which the outside diameter is reduced in a manner enabling impedance matching of the mating contact elements of the mating connector to the contact elements of the connector.

11. Electrical plug-and socket connection as claimed in claim 10, wherein the end of the contact elements which faces the mating contact elements is pin-shaped and the end of the mating contact elements which faces the contact elements is hollow so that the pin-shaped ends of the contact elements can be inserted into the hollow ends of the mating contact elements.

12. Electrical plug-and socket connection as claimed in claim 10, wherein the mating contact carrier of the mating connector comprises four mating contact carrier parts each of which have a quadrant-shaped base surface and at least one bore for accommodating a mating contact element.

13. Electrical plug-and socket connection as claimed in claim 12, wherein the four mating contact carrier parts are separated from one another by a cross-shaped shielding element which extends in the longitudinal direction of the outer sleeve and which is located within the outer sleeve.

14. Electrical plug-and socket connection as claimed in claim 10, wherein the contact carrier of the connector comprises four contact carrier parts each of which have a quadrant-shaped base surface and at least one groove formed in a side thereof and at least one through hole in a side that faces the mating connector.

15. Electrical plug-and socket connection as claimed in claim 14, wherein the four contact carrier parts of the connector are surrounded by a cylindrical sleeve and are separated from one another by a cross-shaped shielding element which is located within the sleeve and which extends in the longitudinal direction of the sleeve.

16. Electrical plug-and socket connection as claimed in claim 15, wherein the mating contact carrier of the mating connector comprises four mating contact carrier parts each of which have a quadrant-shaped base surface and at least one bore for accommodating a mating contact element, wherein the four mating contact carrier parts are separated from one another by a cross-shaped shielding element which extends in the longitudinal direction of the outer sleeve and which is located within the outer sleeve, wherein each of the arms of the cross-shaped shielding element of the connector have an extension on the side facing the mating connector which extends in a longitudinal direction of the connector and wherein each of the arms of the cross-shaped shielding element of the mating connector on the side facing the connector have a corresponding mating extension which extends in the longitudinal direction of the mating connector, the extensions and the mating extensions being made and arranged such that they overlap in the axial direction when the connector and the mating connector are connected to one another.

17. Method for connecting the cores of a multicore cable to an electrical connector having a grip body, a contact carrier for accommodating a plurality of contact elements and a pivotally arranged sleeve-shaped threaded part, the contact carrier having a number of grooves which are outwardly open, which run parallel to a longitudinal axis of the contact carrier, and which correspond in number to the that of the contact elements, and a number of through holes corresponding to the number of grooves being provided in a side of the contact carrier facing away from the cores, bordering the grooves, the method comprising the steps of:

connecting individual stripped ends of the cores of the cable to respective facing ends of the contact elements, inserting the ends of the contact elements facing away from the cores through the through holes of the contact carrier at an angle to the longitudinal axis of the contact carrier greater than zero when pushed through, and pivoting of the inserted contact elements into the grooves in the contact carrier so that the contact elements and cores connected to them run parallel to the longitudinal axis of the contact carrier.

18. Method as claimed in claim 17, wherein individual stripped ends of the cores are inserted into hollow ends of the contact elements and are connected to the contact elements in an electrically conductive manner by mechanical crimping of the ends of the individual cores.

19. Method as claimed in claim 17, wherein the contact carrier is formed of four contact carrier parts each of which have a quadrant-shaped base surface and wherein the connector has a cylindrical sleeve with a cross-shaped shielding element which is located within the sleeve and which extends in the longitudinal direction of the sleeve, the further step of inserting each of the four contact carrier parts with the contact elements located therein into a chamber formed by the cylindrical sleeve and the cross-shaped shielding element.

20. Method as claimed in claim 19, comprising the further step of pushing the sleeve-shaped threaded part onto the sleeve and then casting or molding the grip body over the cores connected to the contact elements and the contact carrier parts.

21. Method as claimed in claim 19, wherein the contact carrier has a shielding sleeve, comprising the further step of pushing the sleeve-shaped threaded part onto the sleeve of the contact carrier and pushing the shielding sleeve over the cores connected to the contact elements and partially over the sleeve, and then, casting or molding the grip body over the shielding sleeve and the cable.

* * * * *